US006540929B2

(12) United States Patent
Wicki et al.

(10) Patent No.: US 6,540,929 B2
(45) Date of Patent: Apr. 1, 2003

(54) METHOD FOR GLUING A COVER PAPER TO THE BACK OF A BOOK BLOCK FORMED FROM BOUND PRINTED SHEETS

(75) Inventors: Raphael Wicki, Aadorf (CH); Peter Geiser, Matzingen (CH)

(73) Assignee: Grapha Holding AG (CH)

( * ) Notice: Subject to any disclaimer, the term of this patent is extended or adjusted under 35 U.S.C. 154(b) by 0 days.

(21) Appl. No.: 09/820,889

(22) Filed: Mar. 30, 2001

(65) Prior Publication Data

US 2001/0025684 A1 Oct. 4, 2001

(30) Foreign Application Priority Data

Mar. 31, 2000 (EP) ..... 00810278

(51) Int. Cl.[7] ..... B42D 3/00; B44C 1/22

(52) U.S. Cl. ..... 216/28; 216/33; 216/52; 216/83; 156/908

(58) Field of Search ..... 216/28, 29, 33, 216/34, 52, 83; 156/153, 221, 257, 308.4, 908; 412/4, 5, 6, 8

(56) References Cited

U.S. PATENT DOCUMENTS 4,091,487 A * 5/1978 Axelrod ..... 281/21.1
4,367,061 A * 1/1983 Wiholm ..... 412/17
5,062,754 A * 11/1991 Bolin et al. ..... 281/21.1
5,340,155 A * 8/1994 Podosek ..... 281/21.1
5,580,097 A * 12/1996 Latvakangas et al. ..... 281/21.1
6,299,402 B1 * 10/2001 Sabelstrom ..... 412/1

FOREIGN PATENT DOCUMENTS

DE 24 51 947 5/1976
JP 08295085 A * 11/1996

OTHER PUBLICATIONS

Furler, Alfred *Technologie der Klebebindung* [*Glue–Binding Technology*];1971; pp. 200–207.

* cited by examiner

*Primary Examiner*—Anita Alanko
(74) *Attorney, Agent, or Firm*—Venable; Robert Kinberg; Chad Anderson

(57) ABSTRACT

A book cover paper that is to be glued to a book block back has material scooped out on the side facing the book back, reducing the thickness of the cover paper at least over the width of the book block back, before the cover paper is joined to the book block back.

14 Claims, 1 Drawing Sheet

METHOD FOR GLUING A COVER PAPER TO THE BACK OF A BOOK BLOCK FORMED FROM BOUND PRINTED SHEETS

CROSS-REFERENCE TO RELATED APPLICATIONS

Priority is claimed with respect to Application No. 00810278.2 filed in Germany on Mar. 31, 2000, the disclosure of which is incorporated herein by reference.

BACKGROUND OF THE INVENTION

The invention relates to a method for gluing a cover paper to the back of a book block formed from bound printed sheets, during the production of books, brochures, magazines or the like. In the process, the cover paper is respectively supplied for the gluing with the inside facing the back of the book block and is subsequently pressed against the book block back as well as the side flanks of the book block back.

This operation is described in, among other things, "TECHNOLOGIE DER KLEBEBINDUNG" [Glue-Binding Technology] by Alfred Furler, Issue 1971, in Section 8.6 "EINHÄNGEN IN UMSCHLÄGE" [Cover Paper Casing].

During the operation, it can happen that the cover papers are coated on the surface with a coating that is incompatible with the glue, so that the joining of cover paper and book block is unsatisfactory. Frequently, the surface is too smooth and results in an insufficient adhesion of the cover paper to the back of the book block.

A chemical process that may occur between the glue and the cover paper surface also inhibits a joining of the book block and the cover paper. Thick cover papers have a negative effect on the opening-up behavior of a book block in the book back region because they increase the unpopular clamping effect on the back.

SUMMARY OF THE INVENTION

It is an object of the invention to provide a method of the type first mentioned above that overcomes the foregoing disadvantages allows for producing a softer and more flexible book back.

The above and other objects are accomplished according to the invention by the provision of a method for gluing a cover paper to a back of a book block having side flanks adjacent the back of the book block, including the steps of: forming the book block from bound printed sheets; supplying a cover paper having one side facing the back of the book block for joining to the book block; reducing a thickness of the cover paper by forming a recess on the one side facing the back of the book block at least across a width of the cover paper corresponding to a width of the back of the book block; and subsequently pressing the cover paper to the back of the book block and to the side flanks of book block.

With this method, it is possible to create a book back that is gentler during use and makes allowances for the opening and use of a bound book, as well as makes it possible to achieve optimum compatibility between glue and cover paper.

The resulting back area, which is relieved of stresses, has a positive effect on the resilience and endurance of a book back during the opening and closing of a book.

Also, the cover papers can be prepared off-line or can be processed accordingly after leaving a cover paper feeder or while on the conveyance path to the book block back.

The cover paper material is advantageously removed in layers, at least over the width of the book block back, so that a normal surface remains.

The cover paper material is preferably removed mechanically or chemically, in a manner known to those skilled in the art.

The exposed surface can be reworked or reprocessed to optimize the glue connection between book block and cover paper.

The scooping out of the recess on the cover paper can occur before or after decorative grooves are produced on the outside of the cover paper.

The operation according to the invention can be carried out in a glue-binding apparatus.

The invention is explained in the following with the aid of an exemplary embodiment and by referring to the drawing, which may be referred to for all details not explained further in the description.

DETAILED DESCRIPTION OF THE INVENTION

Figure 1:
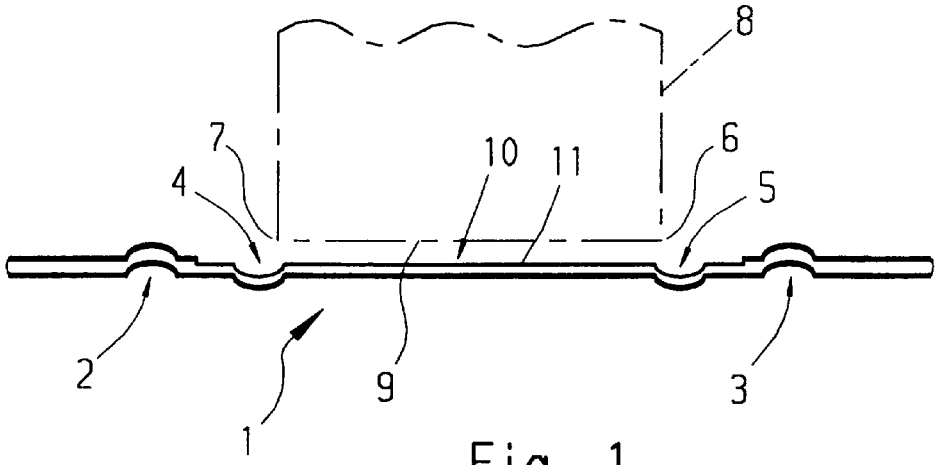
FIG. 1 is a schematic sectional view of a stretched-out cover paper in accordance with the invention with a book block shown in dashed line in a position ready for casing.
Figure 2:
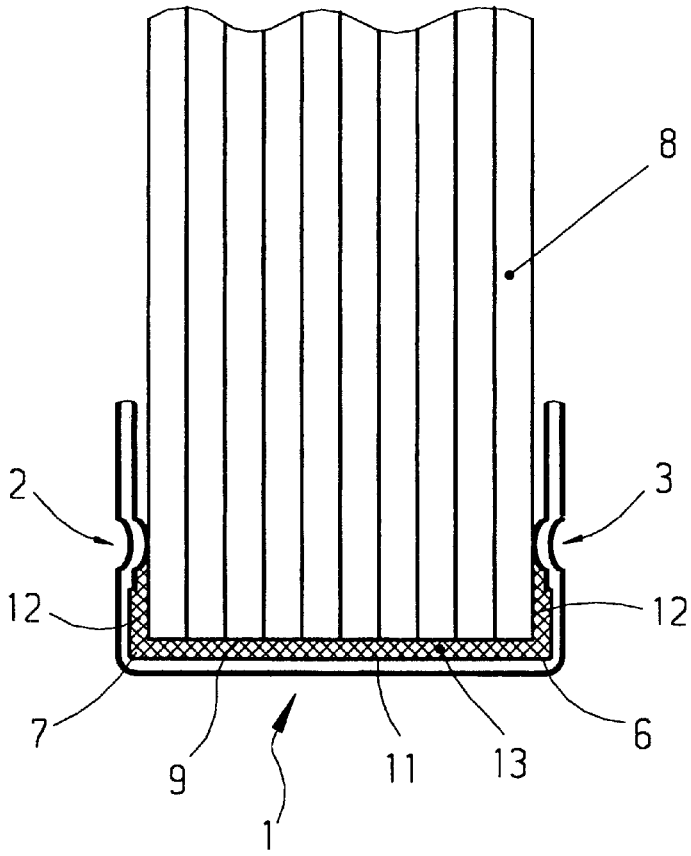
FIG. 2 is a sectional view showing a cover paper according to the invention glued to the back of a book block.

FIG. 1 shows a cover paper 1 provided with four hollow grooves, wherein the two hollow grooves on the outside form so-called decorative grooves 2, 3, which function as hinges for the book cover. The inside grooves 4, 5 function as borders for the book back edges 6, 7 of a book block 8, as shown in FIG. 2. FIG. 1 shows a bound book block 8, arranged evenly spaced between the grooves 2 to 5 and at a distance to the book cover 1. Book cover 1 is provided on the side facing the book block back 9 with a recess 10 that nearly extends to the decorative grooves 2, 3 and projects to the sides past the book block back 9 for the purpose of applying glue to the flanks. The boundary lines of the cover 1, which are drawn opposite the line representing the bottom 11 of the recess 10, are intended to show that the latter is provided on both sides with a coating of glue. The recess 10 extends uniformly over most of the cover paper height. The recess 10 can be mechanically created through cutting or scooping, or by applying an aggressive (chemical) means, both of which are techniques are well known to those skilled in the art, A post-processing or post-treatment of the bottom 11 of recess 10 could be favorable for the later joining with glue.

FIG. 2 shows a book finished in accordance with the book cover 1 shown in FIG. 1. For example, the cover page that is supplied undershot by a cover paper feeder to the book block back 9, is provided with a recess 10 that is scooped out either off line, or while traveling to the cover station of a glue-binding apparatus and is provided with a glue coating 13. Parallel to this, glue can be applied in the glue-binding apparatus to the sides, meaning to the flanks on the book block back 9. The book cover 1 is then supplied from below to the book block back 9 and is pressed from below against the book block back 9 as well as against the flanks 12 of the book block back 9 (as disclosed in "Technology of Glue-Binding" by Alfred Furler, Issue 1971, supra). The glue application 13 is designed to join the book block 8 to the cover 1 in the area between the decorative grooves 2, 3.

The hatched area in FIG. 2 shows the glue applied to the book block back 9 and/or the flank 12, as well as the glue in the recess 10. This glue fills the space bordered by the book block back, the decorative grooves 2, 3 and the cover 1 or the recess 10.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for gluing a cover paper to a back of a book block having side flanks adjacent the book block back, comprising steps of:

forming the book block from bound printed sheets;

supplying a cover paper having one side facing the back of the book block for joining to the book block, said cover paper being a single piece soft-cover paper;

reducing a thickness of the cover paper by forming a recess on the one side facing the back of the book block at least across a width of the cover paper corresponding to a width of the back of the book block; and subsequently pressing the cover paper to the back of the book block and to the side flanks of book block.

2. The method according to claim 1, wherein the reducing step includes one of (a) processing the cover paper off line, (b) processing the cover paper after leaving a cover paper feeder, and (c) processing the cover paper while on the path of being conveyed to the book block back.

3. The method according to claim 1, wherein the reducing step includes removing layers from the cover paper at least over the width of the book block back in order to form the recess.

4. The method according to claim 3, wherein the reducing step includes mechanically removing the material.

5. The method according to claim 4, wherein the removing step includes scooping the material out.

6. The method according to claim 4, wherein the reducing step results in an exposed surface and the method further includes re-processing the exposed surface.

7. The method according to claim 1, including forming decorative grooves in the book cover on the side of the book cover opposite the one side, wherein the reducing step includes forming the recess between the decorative grooves.

8. The method according to claim 7, wherein the reducing step includes scooping out the recess before the decorative grooves are formed in the book cover.

9. The method according to claim 7, wherein the reducing step includes scooping out the recess after the decorative grooves are formed in the book cover.

10. The method according to claim 3, wherein the removing step includes using a chemical process.

11. A method for gluing a cover paper to a back of a book block having side flanks adjacent the book block back, comprising steps of:

forming the book block from bound printed sheets;

supplying a cover paper having one side facing the back of the book block for joining to the book block;

reducing a thickness of the cover paper by forming a recess on the one side facing the back of the book block at least across a width of the cover paper corresponding to a width of the back of the book block by removing layers from the cover paper at least over the width of the back of book block; and subsequently pressing the cover paper to the back of the book block and to the side flanks of book block.

12. A method for gluing a cover paper to a back of a book block having side flanks adjacent the book block back, comprising steps of:

forming the book block from bound printed sheets;

supplying a cover paper having one side facing the back of the book block for joining to the book block and another side opposite the one side;

forming decorative grooves in the cover paper on the side of the cover paper opposite the one side;

reducing a thickness of the cover paper by forming a recess between the decorative grooves on the one side facing the back of the book block at least across a width of the cover paper corresponding to a width of the back of the book block by scooping out the recess before the decorative grooves are formed in the cover paper; and subsequently pressing the cover paper to the back of the book block and to the side flanks of book block.

13. A method for gluing a cover paper to a back of a book block having side flanks adjacent the book block back, comprising steps of:

forming the book block from bound printed sheets;

supplying a cover paper having one side facing the back of the book block for joining to the book block and another side opposite the one side;

forming decorative grooves in the cover paper on the side of the cover paper opposite the one side;

reducing a thickness of the cover paper by forming a recess between the decorative grooves on the one side facing the back of the book block at least across a width of the cover paper corresponding to a width of the back of the book block by scooping out the recess after the decorative grooves are formed in the book cover; and subsequently pressing the cover paper to the back of the book block and to the side flanks of book block.

14. The method of claim 1, wherein the pressing step includes pressing the cover paper directly to the back of the book block.

* * * * *